US005941523A

United States Patent [19]

Kumazaki

[11] Patent Number: 5,941,523

[45] Date of Patent: Aug. 24, 1999

[54] SHEET END DETECTING DEVICE

[75] Inventor: Masayuki Kumazaki, Nagano, Japan

[73] Assignee: Seiko Epson Corporation, Tokyo, Japan

[21] Appl. No.: 09/009,687

[22] Filed: Jan. 20, 1998

[30] Foreign Application Priority Data

Jan. 20, 1997 [JP] Japan ..... 9-021057

[51] Int. Cl.[6] ..... C21C 5/30

[52] U.S. Cl. ..... 271/226; 271/258.03; 399/21

[58] Field of Search ..... 399/21; 271/258.03, 271/226

[56] References Cited

U.S. PATENT DOCUMENTS 4,804,998 2/1989 Miyawaki ..... 399/21
5,039,085 8/1991 Stallmach .

FOREIGN PATENT DOCUMENTS 530734 5/1993 Japan .
2 004 843 4/1979 United Kingdom .

*Primary Examiner*—Harold I. Pitts
*Attorney, Agent, or Firm*—Sughrue, Mion, Zinn, Macpeak & Seas, PLLC

[57] ABSTRACT

The sheet end detector unit (10) is provided with a supporting plate (13), a depressed bearing part (14) for bearing against a sheet discharge roller shaft (5) and a pair of leg pieces (15) which engage with the sides of a unit attachment hole (3) provided in a sheet guide plate (1). The supporting plate (13) supports the sheet end detector unit (10) which is readily positioned on the sheet discharge roller shaft (5) by simply inserting the supporting plate (13) through the attachment hole (3) so that the legs (15) are securely engaged at one side of the supporting plate (13) and the other side of the supporting plate (13) abuts against the rear side of the sheet guide plate (1).

5 Claims, 2 Drawing Sheets

SHEET END DETECTING DEVICE

BACKGROUND OF THE INVENTION

1. Technical Field of the Invention

The present invention relates to a sheet end detecting device. More particular, the present invention is directed to a sheet end detecting device which is disposed in a sheet conveyance path of a device such as a printer, a photocopier, or the like.

2. Description of the Related Art

A sheet end detecting sensor which is disposed in a part of a sheet conveyance path and which is utilized in a printer, a photocopier, or the like, for detection of a front end and a rear end of a sheet and output thereof, generally has a structure wherein a tip of a detection lever is attached to a member in the vicinity of a sheet conveyance roller so as to protrude from a sheet guide plate.

Due to this structure, conventional printers and photocopiers require a lot of time and labor during the assembling process thereof because the sheet end detecting sensor must be attached to a definite part of the apparatus. In addition, it must be placed in an accurate position against the sheet conveyance roller.

SUMMARY OF THE PRESENT INVENTION

In view of such problems as described above, the object of the present invention is to provide a new sheet end detecting device which can be simply attached to a device, such as a printer, during the final step of assembling operations.

Another object of the present invention is to provide a sheet end detecting device which can be positioned easily and accurately, so as to be secured against a sheet conveyance roller.

In a sheet end detecting device which solves such problems as described above, a depressed part that bears a sheet conveyance roller shaft and a pair of leg pieces that elastically engage with both lateral side edges of an attachment hole on a sheet guide plate are provided on one side of a supporting plate that sustains a sheet end detecting element, while the other side of the supporting plate is in contact with a rear surface of the sheet guide plate in a state wherein the attachment hole is engaged with the leg pieces.

In such a structure as described above, the depressed bearing part which is provided in the supporting plate is turned over while being fitted with the sheet conveyance roller shaft and the pair of leg pieces which protrude from the supporting plate are engaged with the attachment hole so that the sheet end detecting device is accurately positioned on and supported by the sheet conveyance roller shaft.

DESCRIPTION OF THE PRESENT INVENTION

Figure 1:
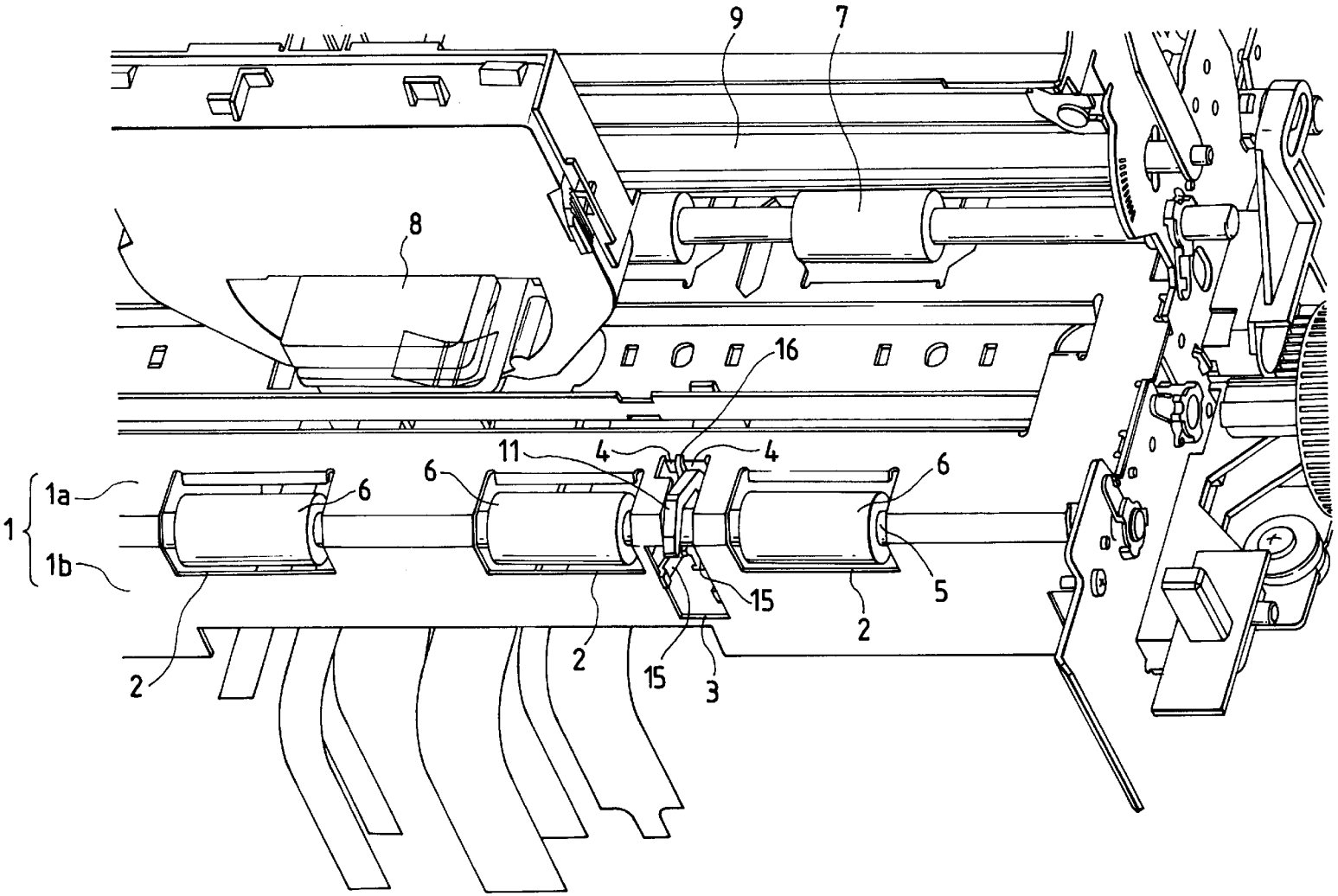
FIG. 1 is a perspective view of principle parts of a printer whereunto a sheet end detecting device as an embodiment of the present invention is assembled.
Figure 2:
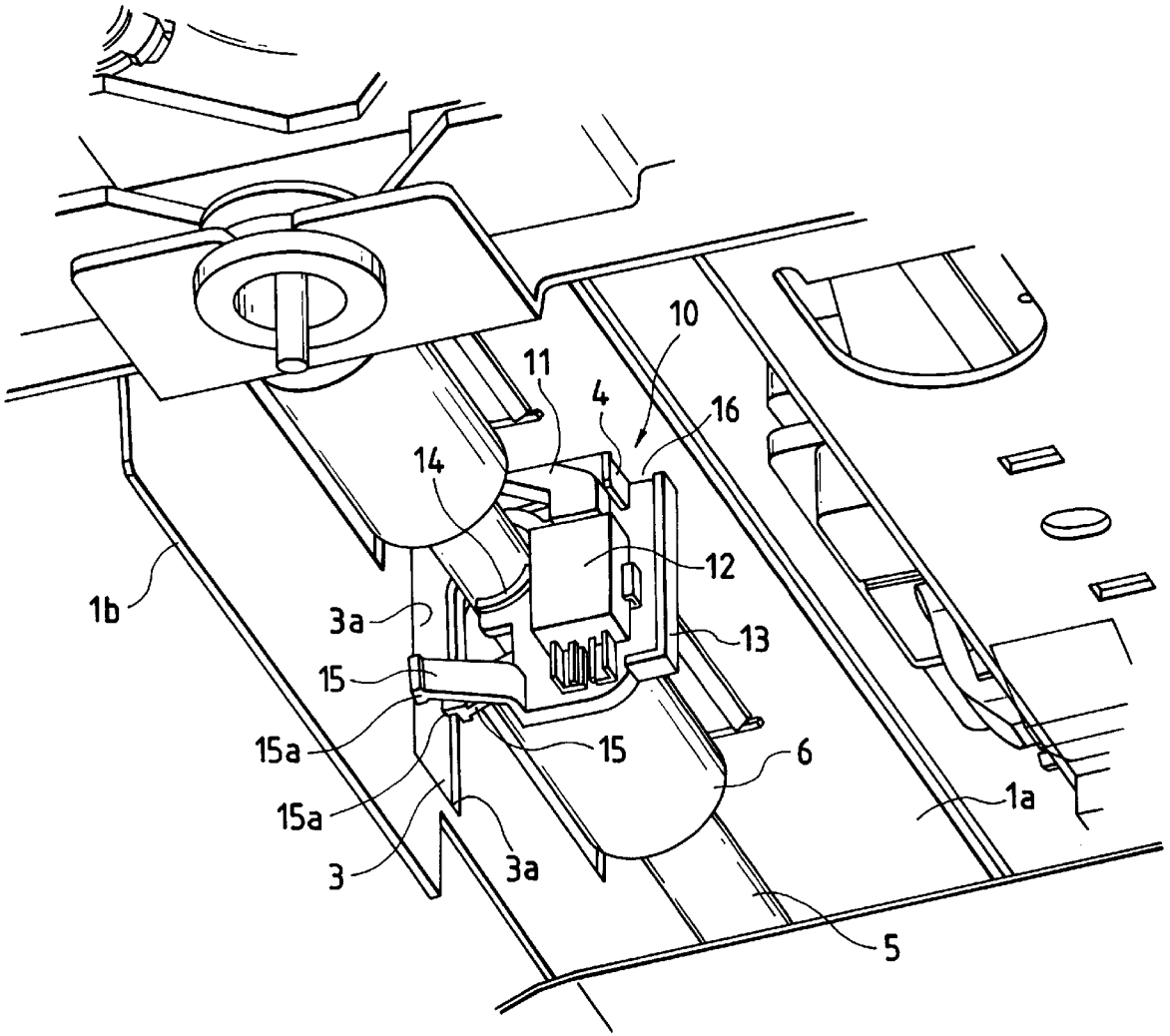
FIG. 2 is a perspective view of the rear side of the sheet end detecting device.

An embodiment of the present invention will now be described. FIG. 1 shows a printer which comprises a sheet end detecting sensor viewed on the sheet exit side of the printer and FIG. 2 shows a view on the rear side.

As shown in the drawings, a sheet guide plate 1 has a horizontal part 1*a* which extends toward the sheet exit side and is bent downward at an end part thereof to form a vertical part 1*b*. The bent part of the guide plate 1 is provided with an array of a plurality of window holes 2 in a widthwise direction, through which each of rollers 6 that are secured on a common sheet discharge roller shaft 5 is disposed so as to expose a circumferential part thereof from a rear side of the sheet guide plate 1, and a unit attachment hole 3, which is slightly wider than a sheet end detector unit 10 described below, is formed by stamping between the above-described window holes 2.

The sheet end detector unit 10 which is attached to the sheet discharge roller shaft 5 through the unit attachment hole 3 comprises a detecting lever 11 which is provided so as to protrude a tip thereof from the sheet guide plate 1 and which is supported so as to swing freely, a limit switch 12 which outputs a sheet end detecting signal based on actions of the detecting lever 11 and a supporting plate 13 which supports these components.

The supporting plate 13 is formed of an elastic resin. On one side of the supporting plate 13, a semicircular depressed attachment part 14 for elastic bearing of the sheet discharge roller shaft 5 is formed. On the same side as the depressed attachment part 14, two leg pieces 15 which each have an engagement claw 15*a* at the tips, protrude and stretch apart so as to make elastic engagement with both lateral side edges 3*a* of the unit attachment hole 3 (see FIG. 2).

The other side of the supporting plate 13 has a lateral side edge 16 which is in contact with a rear surface of the horizontal part 1*a* of the sheet guide plate 1 when the two leg pieces 15 are being engaged with the lateral side edges 3*a* of the unit attachment hole 3. The lateral side edge 16 is stopped by and secured to the rear surface of the sheet guide plate 1 after being turned over from the front surface side, using the sheet discharge roller shaft 5 as a fulcrum. This part of the sheet guide plate 1 which abuts the side edge 16, is bent inward to form a pair of holder pieces 4 so that the lateral side edge 16 of the supporting plate 13 is held between both holder pieces 4.

A sheet feed roller 7, an impact type recording head 8 and a carriage guide 9 are also shown in the drawings.

To assemble the sheet end detector unit 10 of the above-described structure into the printer, the sheet end detector unit 10 is inserted to the rear side of the sheet guide plate I through the unit attachment hole 3 in the sheet guide plate 1 while the tip of the detecting lever 11 is directed upward, and the supporting plate 13 is attached to the sheet discharge roller shaft 5 so that the depressed attachment part 14 is fitted on the sheet discharge roller shaft 5 from below.

If the supporting plate 13 is rotated halfway around in the counter-clockwise direction in the drawing with the sheet discharge roller shaft 5 as the fulcrum, the two leg pieces 15 that protrude from one side of the supporting plate 13 are squeezed to enter the unit attachment hole 3 at a position close to the end of the rotation and are locked by the engagement claws 15 engaging with the lateral side edges 3*a*. Simultaneously, the lateral side edge 16 of the supporting plate 13 which comes into contact with the rear surface of the horizontal part 1*a* of the sheet guide plate 1 is held between the holder pieces 4 which are formed at both sides thereof by bending, as shown in FIG. 2, to be attached to the sheet discharge roller shaft 5.

Therefore, this sheet end detector unit 10 can be attached readily to a completely assembled printer without the use of screws. In addition, the sheet end detector unit 10 can be removed simply by reversing the attachment procedures. Moreover, since the sheet discharge roller shaft 5 is utilized as a datum for positioning, the front end and rear end of the recording sheet can be detected with an extreme accuracy.

Although the present invention has been exemplified with an embodiment wherein the sheet end detector unit is disposed on the sheet exit side, it should be clearly understood that this may be disposed on the sheet entrance side.

In accordance with the present invention, as discussed above, the depressed part that bears the sheet conveyance roller shaft and the pair of leg pieces that engage with the attachment hole on the sheet guide plate are provided on one side of the supporting plate that sustains the sheet end detecting element, while the other side of the supporting plate is in contact with the rear surface of the sheet guide plate in the state wherein the attachment hole is engaged with the leg pieces. After the supporting plate is inserted to the rear side of the sheet guide plate through the attachment hole and fitted on the sheet conveyance roller shaft, the supporting plate is turned over until the leg pieces are in place for engagement in the attachment hole. Thus, the present invention realizes not only the simple assembling operation of the sheet end detecting device into a part of the sheet transporting path without the use of attachment screws, but also the simple removing operation by reversing these operations. Furthermore, positioning of the sheet detection unit with the sheet conveyance roller shaft as the datum thereof greatly enhances the detecting accuracy of the front end or the rear end of the sheet.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A sheet end detecting device, comprising:

a sheet end detecting element;

a supporting plate for sustaining said sheet end detecting element;

a depressed portion on one side of said supporting plate for bearing against a sheet conveyance roller shaft;

a pair of leg pieces on the one side of said supporting plate for elastically engaging with both lateral side edges of an attachment hole on a sheet guide plate; and a contact portion on another side of said supporting plate, wherein said contact portion contacts with a rear surface of said sheet guide plate when said attachment hole and said leg pieces are in a state of engagement.

2. The sheet end detecting device according to claim 1, wherein said sheet guide plate comprises a sheet conveyance surface and a wall surface that is disposed at an approximately right angle to said sheet conveyance surface, and wherein said attachment hole is provided in said wall surface.

3. The sheet end detecting device according to claim 1, wherein said leg pieces each have an engagement claw formed on an end portion thereof.

4. The sheet end detecting device according to claim 1, wherein said rear surface of said sheet guide plate comprises a pair of inwardly bent pieces for abutting said contact portion of said supporting plate.

5. The sheet end detecting device according to claim 1, further comprising a limit switch for outputting a sheet end detecting signal in accordance with an action by said sheet end detecting element.

* * * * *